United States Patent [19]

Heyde

[11] Patent Number: 4,700,028

[45] Date of Patent: Oct. 13, 1987

[54] PORTABLE BREAKLOAD TOOL

[75] Inventor: Hans H. Heyde, Catarina, Brazil

[73] Assignee: Lorenzetti-Inebrasa S/A, Santa Catarina, Brazil

[21] Appl. No.: 888,791

[22] Filed: Jul. 21, 1986

[30] Foreign Application Priority Data

Aug. 1, 1985 [BR] Brazil ..... 8503644

[51] Int. Cl.[4] ..... H01H 33/12

[52] U.S. Cl. ..... 200/146 R; 200/148 H; 200/150 C

[58] Field of Search ..... 200/14 R, 148 H, 144 R, 200/150 C

[56] References Cited

U.S. PATENT DOCUMENTS

| | | | |
|---|---|---|---|
| 2,144,414 | 1/1939 | Milliken | 200/150 C |
| 2,644,877 | 7/1953 | Guillaume | 200/150 C |
| 2,816,982 | 12/1957 | Barta | 200/146 R |
| 2,838,636 | 6/1958 | Schwager | 200/146 R |
| 3,371,176 | 2/1968 | Leeds | 200/148 H |

FOREIGN PATENT DOCUMENTS

| | | | |
|---|---|---|---|
| 1293518 | 4/1962 | France | 200/150 C |

*Primary Examiner*—Robert S. Macon

*Attorney, Agent, or Firm*—Michael J. Striker

[57] ABSTRACT

A portable breakload tool which permits opening of electric devices under load so that the opening is made without apparent external arc. The tool includes an arch quenching chamber in which two fixed contacts and a rotatable contact are positioned. The movable contact is operated externally to cut current between the contacts. The electric arc is confined within the chamber and is quenched by the sulfur hexafluoride gas which fills the chamber.

7 Claims, 7 Drawing Figures

PORTABLE BREAKLOAD TOOL

BACKGROUND OF THE INVENTION

This relates in general to circuit breakers and, in particular, to system operating devices, such as for instance, load break switches or switch fuses.

This herein described device, known in English speaking countries as "Portable Breakload Tool", is a portable tool, which permits the opening under load of electric devices which had not been foreseen for this purpose, that is, which do not have chambers to open under load.

The opening under load of this device, which is the subject of this patent application, is made without there existing an apparent outside arc.

Any arc generated by operation is quenched inside the chamber of this device. This invention is an improvement of the U.S. Pat. No. 2,816,982.

SUMMARY OF THE INVENTION

It is an object of the present invention to provide an improved breakload tool. The advantage of this invention is that it offers to cut off the current inside an insulating gas, for example sulfur hexafluoride, SF6.

This tool can also be used to open load break switches inside electric panels or to be used as fixed load break chamber in load break switches for outdoors or inside use.

Another object of this invention is to provide more appropriate methods to open a circuit under load, the arc being quenched inside a chamber which contains SF6 (sulfur hexafluoride) gas under pressure.

The purpose of this patent application is, therefore, the use of this special chamber type of the portable load break tool unit. Different embodiments of this chamber have already been subject of Brazilian patent application No. 8302405, dated May 9, 1983, filed by the same author under the title "CAMARA PARA CONJUNTO PORTATIL DE MANOBRA DE CHAVES SECCIONADORAS" (Portable unit for load break switch handling), and in the United States under the title "INSULATING CHAMBER", U.S. patent application No. 679,017 of Dec. 6, 1984.

This disclosed describes the complete unit and, particularly, the mechanism of the chamber, both of its outside part where the mechanism is placed, and the inside part which is under the SF6 gas pressure, and which consists of the electric arc quenching chamber.

This tool may be used such as is shown in FIGS. 1 and 2, fully assembled, as well as it is possible to use only the current breaking chamber assembly for the use of other equipments, such as load break switches for inside or outdoor use.

BRIEF DESCRIPTION OF THE DRAWINGS

FIG. 2 is divided into two figures. 2A and 2B, which when

DETAILED DESCRIPTION OF THE PREFERRED EMOBIDMENTS

Figure 1A:
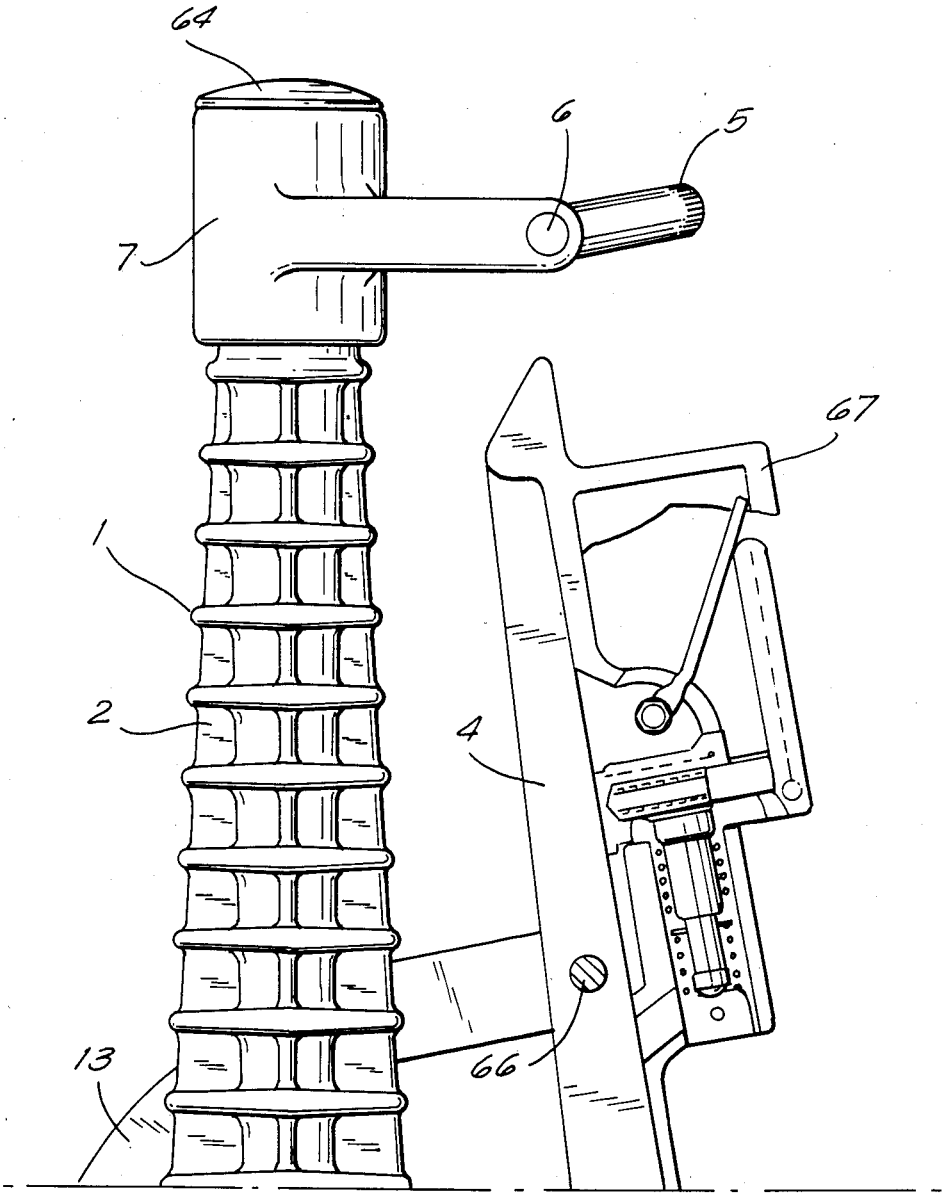
FIGS. 1A and 1B–when FIG. 1A—1A placed above FIG. 1B show a side view of the device in the assembled position, where the section of the arc quenching chamber is seen.
Figure 1B:
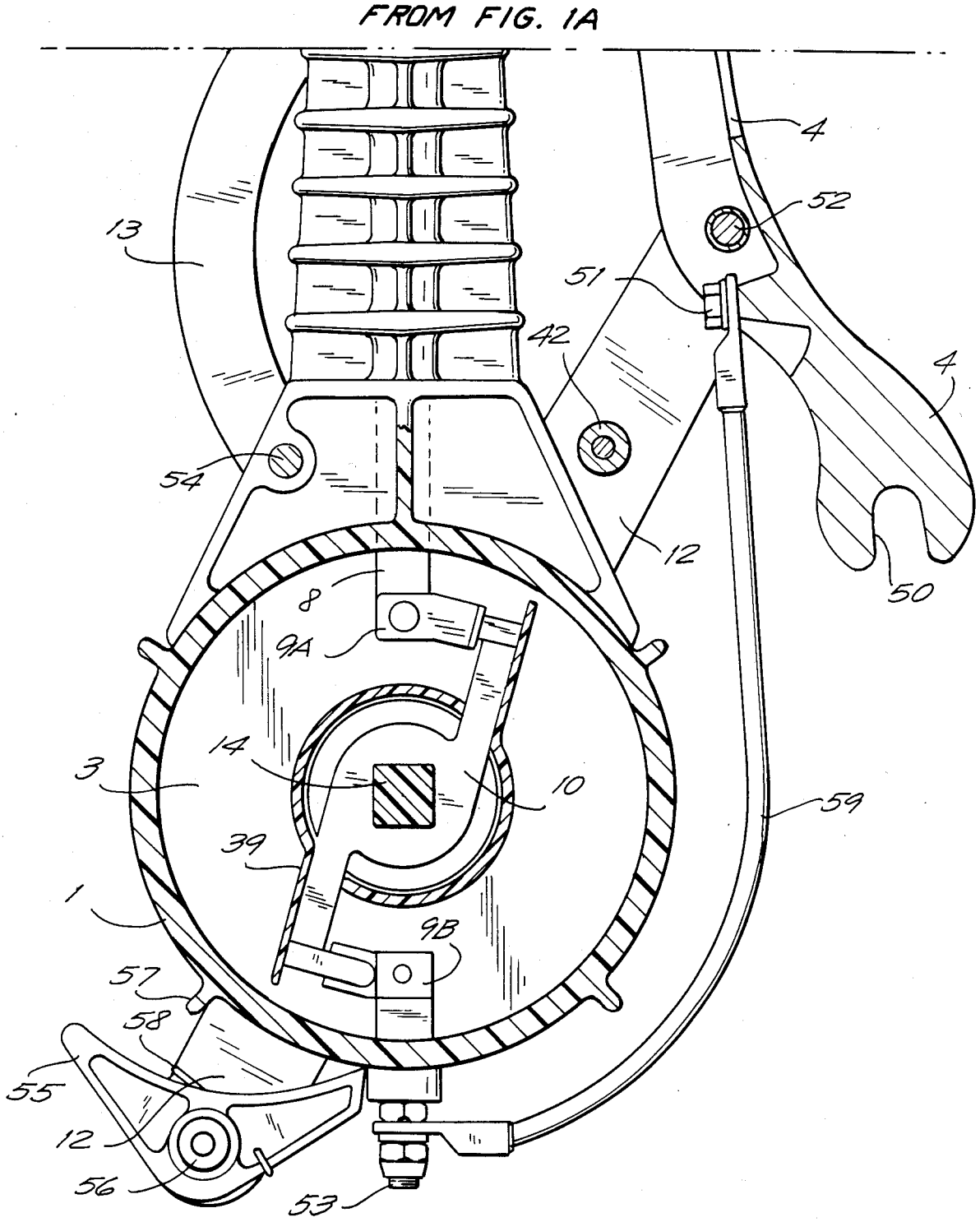
Figure 2A:
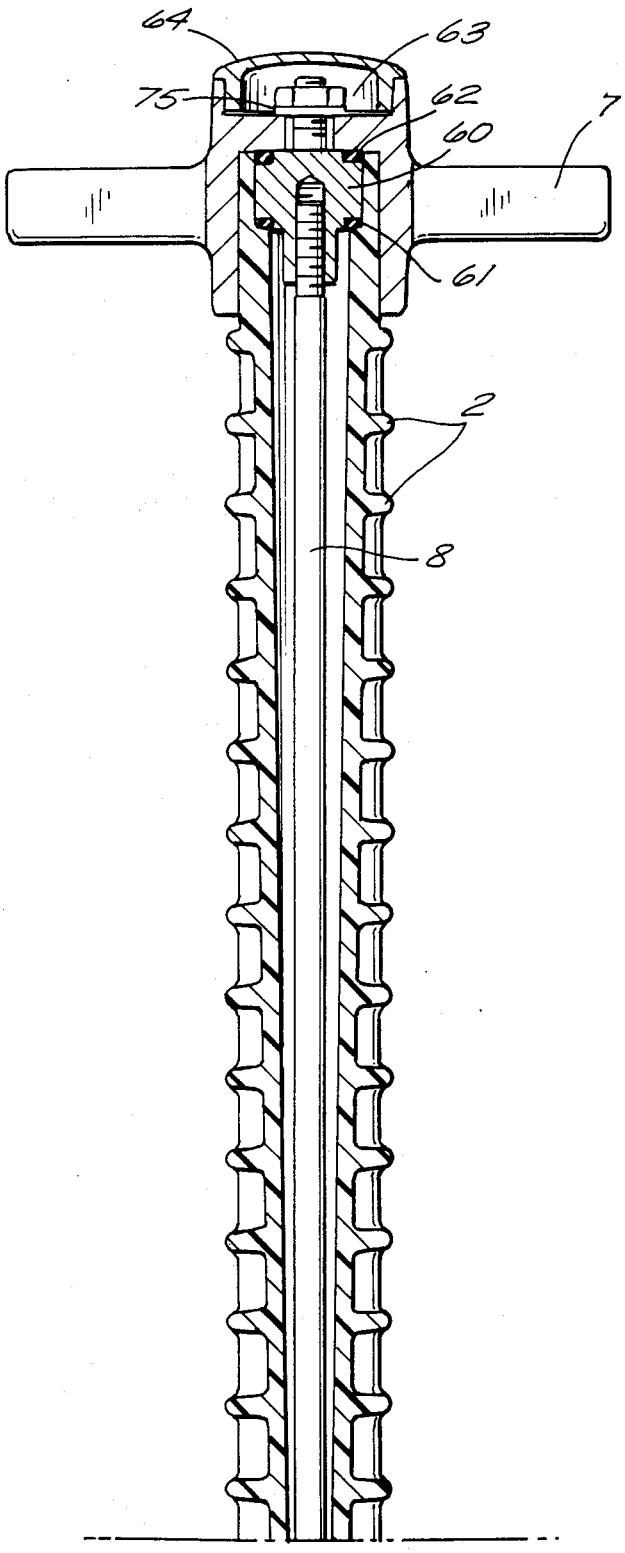
FIG. 2A is placed above
Figure 2B:
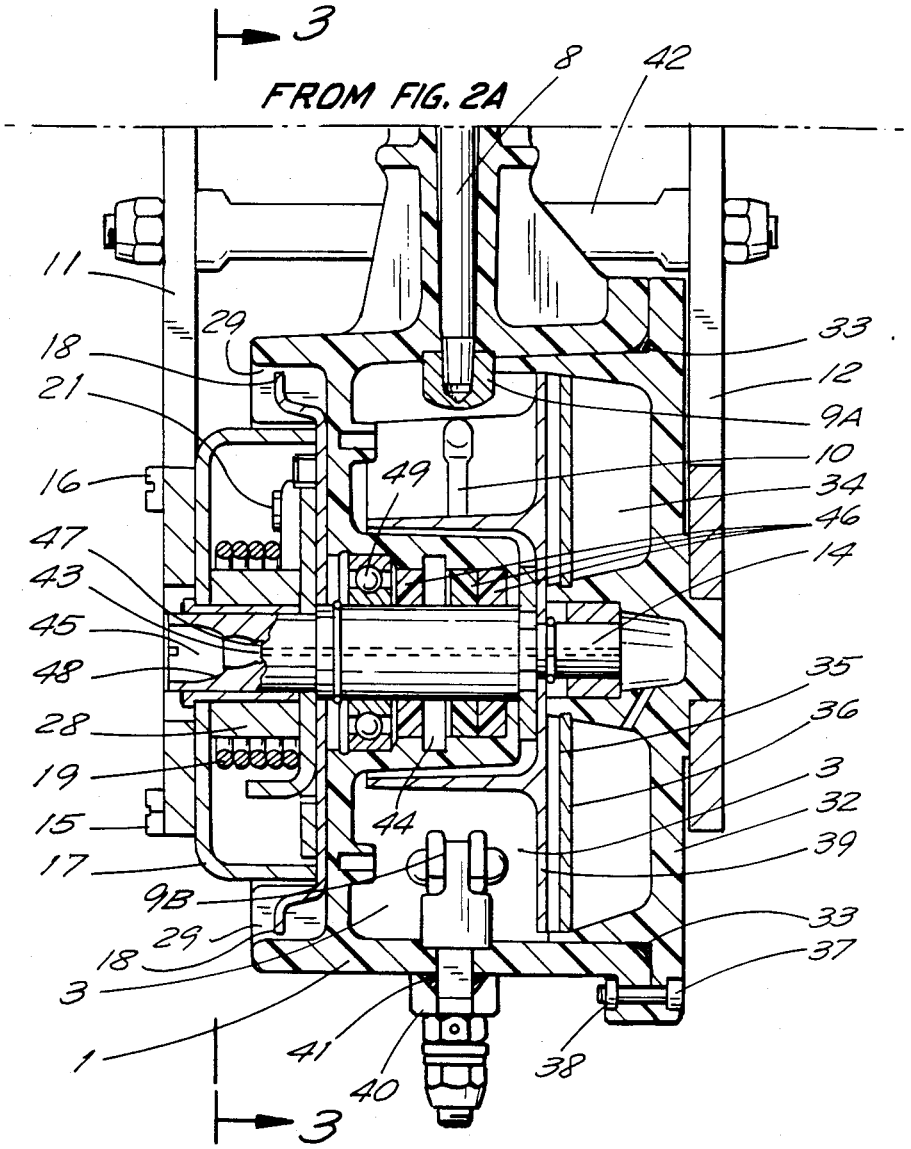
FIG. 2B, show a view of the underside of the device of FIGS. 1A and 1B in the assembled position and cut in the middle.

FIG. 1 FIGS. 1A and 1B shows main components of the system, which are an insulating body (1), a coupling metallic arm (4), two main insulating joints (11) and (12) (in this figure only joint (12) is visible, whilst joint (11) may be seen in FIG. 2B) and two secondary insulating joints (13) which join the coupling arm (4) to the body (1).

The electric current traverses an device through the articulated metallic anchor (5), passing over a metallic clevis (7) through an anchor pin (6) and is thereafter conveyed to the inside of a chamber through the metallic straining beam (8) to which a fixed metallic contact (9A) is rigidly connected. A moving contact (10) permits that the current passes through it to a second fixed contact (9B).

From this moment on the electric current leaves the inside of a chamber through a metal stud (53) and a flexible metallic cordage (59). This cordage, which is placed on the outside of the device connects electrically the second fixed contact (9B) of the arc quenching chamber to the coupling arm (4) through a bolt (51). The electric current finally reaches the equipment which is operated by metallic arm (4) and by a hook (67) which establishes an electrical contact with the coupling operated.

The device of this invention is clamped at its cogged end (50) to an insulated operating rod (not shown in FIG. 1B), which is operated by hand from the floor, from a ladder or an insulated bucked placed on an adequate truck.

This coupling arm (4) and the anchor (5) correspond to the same parts which perform identical functions as those of the U.S. Pat. No. 2,816,982 mentioned above.

When the operator clamps the anchor (5) on the fixed part of the load break switch being operated and its movable part (67) to the hook of this device, he pulls the coupling arm during the whole time of the load break switch opening, the current runs through the tool.

During this movement, the coupling arm (4) makes circular movements around the chamber (3), being articulated on pins (66) and (52) and on pin (54). The main joint (12) (FIG. 2B) is linked on the side of the body (1) on a lug placed in the center of a cover (32) of the body (1), once it is connected to this device through the main joints (11) and (12) and the secondary joints (13). The main joint (11) is linked on the side of a body (1) by the jacket (17) (FIG. 2B).

It may be seen in FIG. 2B that the main joint (11) activates, in turn, during the whole breaking course, the jacket of the joint (17), which is firmly connected to the same by means of screws (15) and (16).

Figure 3:
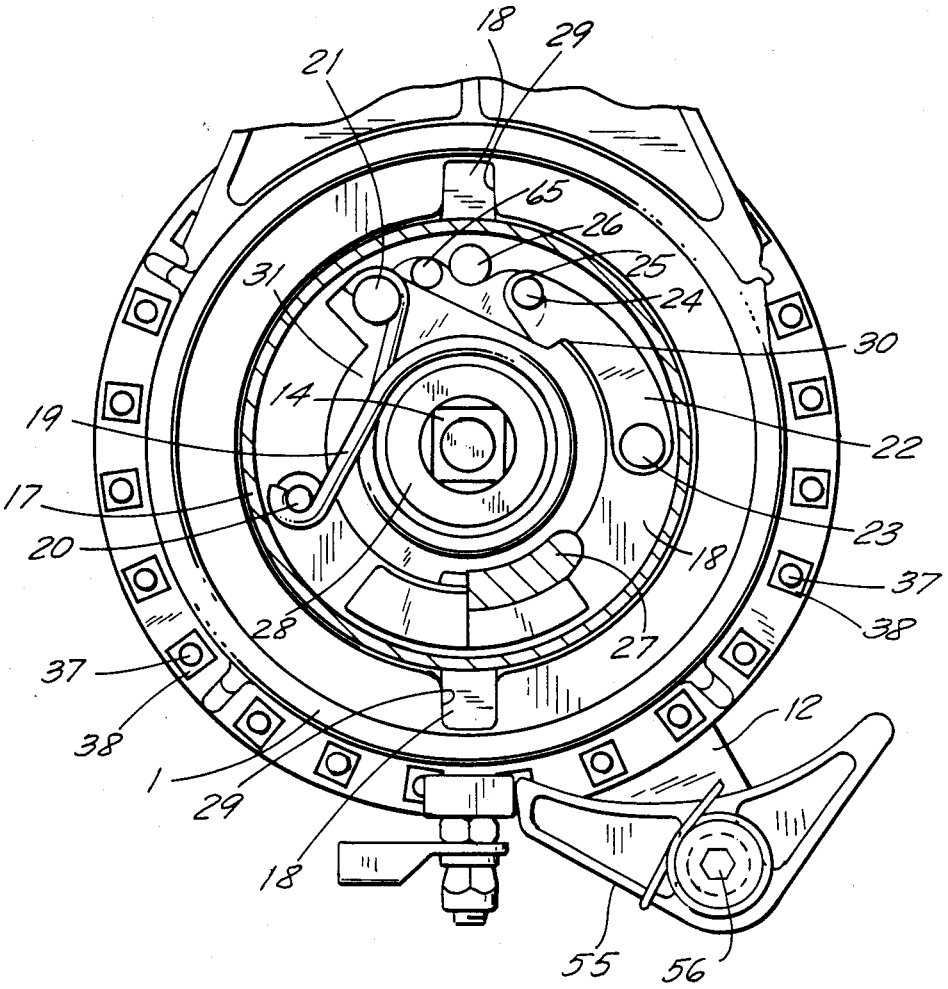
FIG. 3 is a section view along line A—A of FIG. B of the trip spring action mechanism in FIG. 2B.

This jacket (17), in turn, activates a release spring (19), during the movement, the same being pressed down through the pin of a jacket (20), as may be seen in FIG. 3.

The other end of the spring is held fast by the pin of mirror (21).

When the travel of the main joint (11) comes to its end, the distance between the anchor (5) and the hook (67) (as seen in FIG. 1A) becomes electrically safe for the equipment which is being operated and, at this moment, due to the operator's continuous action to pull the coupling arm (4), this movement causes the continuation of the main joint (11) movement.

When reaching the position, where there exists this safe distance, this movement causes the trip of the spring (19), (see in FIG. 2B and FIG. 3), which, in turn, causes the abrupt rotating movement of the moving contact (10) (seen in FIGS. 1B, 2B, 4 and 5).

When the moving contact (10) opens then occurs the desired current cutoff, whereas the electric arc remains confined in the breaking chamber (3) of the device between the ends of the moving contact (10) and of the fixed contacts (9A) and (9B) and, consequently, there is no electric arc on the tool outside.

FIG. 3 shows the main components of the tripping mechanism, which was designed to provide quick opening of the moving contact (10) at a speed which is always the same, regardless of whichever speed is chosen by the operator.

When the operator pulls its insulated operating rod, which is screwed at the end of the metallic coupling arm (4), FIG. 1B, this arm is articulated around the body (1) through the main joints (11) and (12), manufactured of insulating materials, and through the two secondary joints (13), also made of insulating material.

In FIG. 3, the movement of the main joint (11) lower end, which is also connected to the main joint (12) by means of the beam (56), occurs in the counterclockwise direction.

The main joint (11) is not shown in FIG. 3 to make the comprehension of this figure easier, but both main joints rotate simultaneously, once they are connected to each other by the upper distance piece (42) and by the lower distance piece (56) as is shown in FIG. 1B. Both distance pieces are manufactured with insulating material.

In its counterclockwise movement, the main joint (11), as shown in FIG. 3, carries the jacket (17), which is screwed to the main joint by metallic screws (15) and (16). Firmly connected to the jacket (17) is the jacket pin (20). This pin carries the end of the release spring (19). The other end of the release spring (19) is fastened to the pin of mirror (21), which is fixed to a slide (31).

The slide (31) is built-in fittingly in a main drive gear (14), which has at this place a square notch, so that when the slide (31) rotates, it will always carry the main drive gear (14).

During the counterclockwise movement of the pin of the jacket (20), the release spring (19) is pressed, once the slide (31) cannot rotate, as the trip mechanism (22) prevents it from doing it. The spring (19) rests on the support of spring (28), which gives it the due stability.

The trip mechanism (22) is linked on the pin (23) of the trip mechanism, which is rigidly connected to a mirror (18) which is in turn fastened to the body (1) by its two lugs (29).

The point of the trip mechanism (22) is fitted into a notch (30) of the slide (30), thus impeding to the slide (31) a movement and therefore, of the spring (19) end which is held fast by the mirror pin (21). The end of the trip mechanism (22) is driven in the direction of the slide (31) by means of a spring (25) which is resting on the trip mechanism (22) by pin (24) and is clamped to the mirror (18) by pins (26) and (65).

At the same time the jacket (17) carries and compresses the spring (19) through the pin of a jacket (20), the driving cam (27), which is also built-in in this jacket, comes near the tripping pin (24) which is fastened to the moving end of the trip mechanism (22).

When the driving cam (27) engages the tripping pin (24), which occurs at the end of opening stroke of the coupling arm (4), the driving cam (27) lifts the tripping pin (24) which lifts the end of the trip mechanism (22), releasing the notch (30) of the slide (31), which is, then, violently impelled in the rotary direction by the action of the spring (19), which causes the same movement on the main drive gear (14) (FIG. 1B), which, in turn, conveys this quick rotary movement to the moving contact (10) placed inside the arc quenching chamber (3).

The moving contact (10) and the fixed contacts (9A) and (9B) are located inside the arc quenching chamber (3), which is a component part of the body (1).

This arc quenching chamber (3), which is also shown in section in the FIG. 2B contains sulfur hexafluoride SF6 gas under pressure.

This arc quenching chamber (3) is protected by the cover (32) (FIG. 2B), which prevents that the gas escapes to the outside.

This cover (32) seen in FIG. 2B is firmly screwed to the body of the device (1), by means of innumerous screws and nuts (37) and (38), distributed in circle on the cylindrical body of a chamber (34).

This cover manufactured of insulating material also serves in its inner part as the axle guide and bearing and its outside part serves as an axle under which the main joint (12) rotates.

It is also a deposit of activated alumina which is kept back by a screen (36) and placed in the chamber (34). The function of activated alumina is to be a deposit of SF6 and a filter for that gas. The gas under pressure inside chamber (3) cannot escape through the cover (32) due to a sealing ring (33) placed between the cover (32) and the body (1) of the device.

In the same manner, the gas cannot escape through the fixed contact (9B) due to a sealing ring (41) placed there to prevent the leakage of SF6. The gas cannot leak through the drive gear (14) due to the fact that there exist three retainer rings (46). These retainer rings are placed in such a way that between them a certain amount of oil placed in a chamber (44) is kept. In case SF6 wants to pass through the retainers, it will force the oil which will exert pressure under these retainers (46) which will avoid SF6 leakage. Consequently, there exist a liquid joint blocking the gas passage through the main drive gear (14).

A ball bearing (49) set on the body (1) supports the main drive gear (14) so that it rotates freely. The axle may be built in insulating material or in metal.

The electrical connection between the metallic clevis (7) and the fixed contact (9A) is obtained through the metallic beam (8). This metallic beam is screwed onto the clevis (7) by means of a head (60).

Two retainer rings (61) and (62) are placed to avoid the escape of the SF6 gas to the outside.

The metallic beam (8) passes inside the body stem (2). This stem of the body (2) is built with several fins so as to present a quite large discharge line, which provides a large electric insulation between the axle position (14) and the clevis (7), or between a clevis and the seat (40) of the fixed contact (9B).

Both the body (1) and its stem (2) and the arc quenching chamber (3) form a single unit built of insulating material adequate against shock and resistant, both mechanically and electrically. This material has to be sufficiently compact to support in its inside gas SF6, without the danger that the gas leaks through the material molecules. Typically, this material could be of plastic type. The ends of the moving contact (10) are made of tungstene alloys in order to assure a long life. The end fixed contacts (9A) and (9B) are also manufactured of tungstene alloys. These contacts are of self-cleaning type to assure a longer life.

In any of the embodiments, the SF6 gas is introduced into the arc quenching chamber (3) through a plug (43). When this plug (43) is removed, it permits the gas passage through the inner hole in the center of the drive shaft or gear (14) to the inside of the tool chamber (3).

This plug (43) is placed back after the filling into the chamber of SF6 gas, which is maintained inside the tool through the sealing disk and also through an auxiliary plug (45) which is placed over the plug (43).

This plug (45) presses the sealing ring (48) so as to give a double warranty of sealing against SF6 escape from the arc quenching chamber (3).

The electrical protection between the fixed contacts (9A) and (9B) and the moving contact (10) is warranted in the first tool embodiment, as shown in FIG. 1B, by means of an arc protector (39). The ultimate object of this protector is to guaranty the electrical insulation between the moving contact (10) and the fixed contacts (9A) and (9B) in the moment of arc break and at the same time to provide the SF6 gas movement inside the arc quenching chamber (3), which helps the quenching of the electric arc.

As has already been said, the alumina silicate (34) contained in the cover (31) of the chamber (34) (FIG. 2B) is kept by a grate (35) which protects the screen (36) and is installed to stores SF6 and to free from pollution the SF6 used after the arc quenching.

The main joints (11) and (12) and the secondary joints (13) are made of insulating material and permit that the coupling arm (4) articulates smoothly around the tool body (1).

When the tool is fully switched off and the spring (19) is tripped, the device is kept in an open position by means of an external trip mechanism (55) (FIG. 1B). This external trip mechanism (55) is kept in permanent contact with the body (1) through a torsion spring (58), which is placed over a lower distance piece (56), which unites the main joints (11) and (12). This external trip mechanism (55) therefore assures that, once the opening of the load break switch or of another current cut-off equipment, has been completed, its end that engages the device body (1) is coupled to the lug which is part of the body (1) of this tool.

This permits the operator to remove the portable tool without any risk that its circuit closes, which could endanger the operation. To bring back the equipment to its loaded position, it is sufficient that the operator puts his finger on the end of the external trip mechanism (55), which releases the articulation of the coupling arm (4).

A hole made in the jacket of the joint (17) (FIG. 2B), permits that the operator has an effective view of the trip mechanism coupling (22), (FIG. 3) with the slide notch (31), which gives the operator the security that the tool is really loaded and ready to operate.

The hook (67) (FIG. 1A) and other components placed on the upper end of the coupling arm (4), as well as other devices which serve to couple this hook with the equipment lug system (not shown in FIG. 1A), which is operated, is a reproduction of the coupling system mentioned and described in U.S. Pat. No. 2,816,982 and will not be described here in detail, since it is not the subject of this patent.

A protection cover (64) (FIG. 2A) placed onto the clevis end (7) serves to protect a door (63) of a metallic head (60), which establishes the electrical connection between this clevis (7) and the metallic beam (8).

The flexible metallic cordage (59) (FIG. 1B) connects the fixed contact (9B) with the metallic coupling arm (4) and this cordage (59) is connected to the coupling arm (4) by means of a bolt (51) and is connected, on the other side with the fixed contact (9B) by means of the metal stud (53).

A relative movement of the coupling arm (4) in relation to the clevis (7) (FIG. 1A) is, consequently, made freely since the coupling arm (4) will freely rotate around the body (1), being linked by the main joints (11) and (12) and at the secondary joints (13).

The flexible cordage (59) will consequently not be an obstacle to the free movement of the coupling arm (4) around the body (1).

Figure 4:
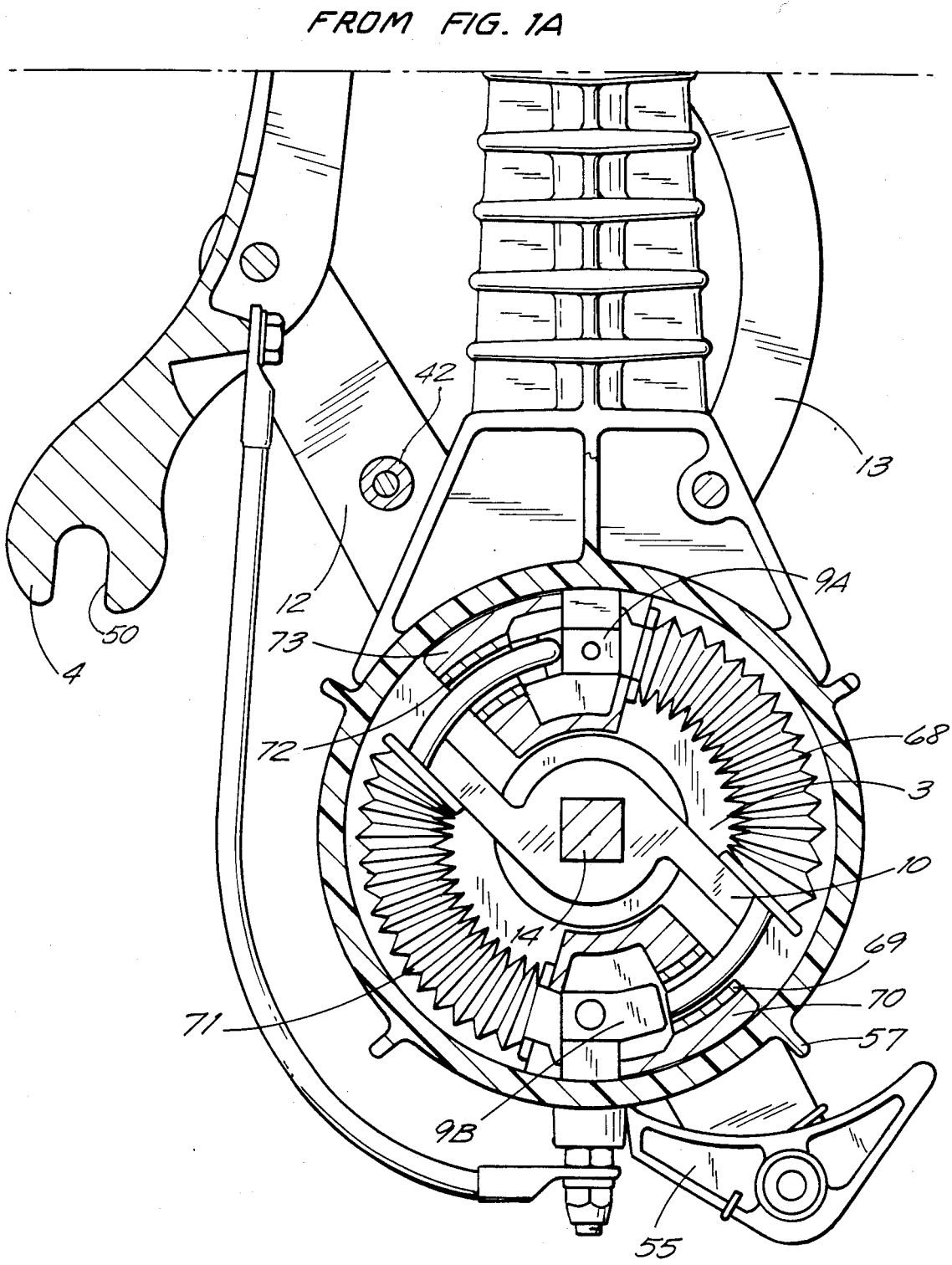
FIG. 4 is a view similar to that of the FIG. 1B, but of the embodiment where the electric arc quenching is made with the help of bellow type blowers.

The tool can also be made in an embodiment which employs two bellows (68) and (71), such as shown in FIG. 4. These bellows are fastened on the one side to the moving contact (10) and on the other side to the body of blowers (73) and (70).

Both the bellows (68) and (71) as the body of blowers (73) and (70) are manufactured in insulating material, the bellows (68) and (71) using for their manufacture an adequate type of rubber or plastic. The body of the blower is made in such a way that the gases are blown aerodynamically in direction to the place where the electric arc will be formed.

The input hole in the body of the blowers (73) and (70) is protected from the electric arc by parts (69) and (72), manufactured of plastic type P.T.F.E.

Figure 5:
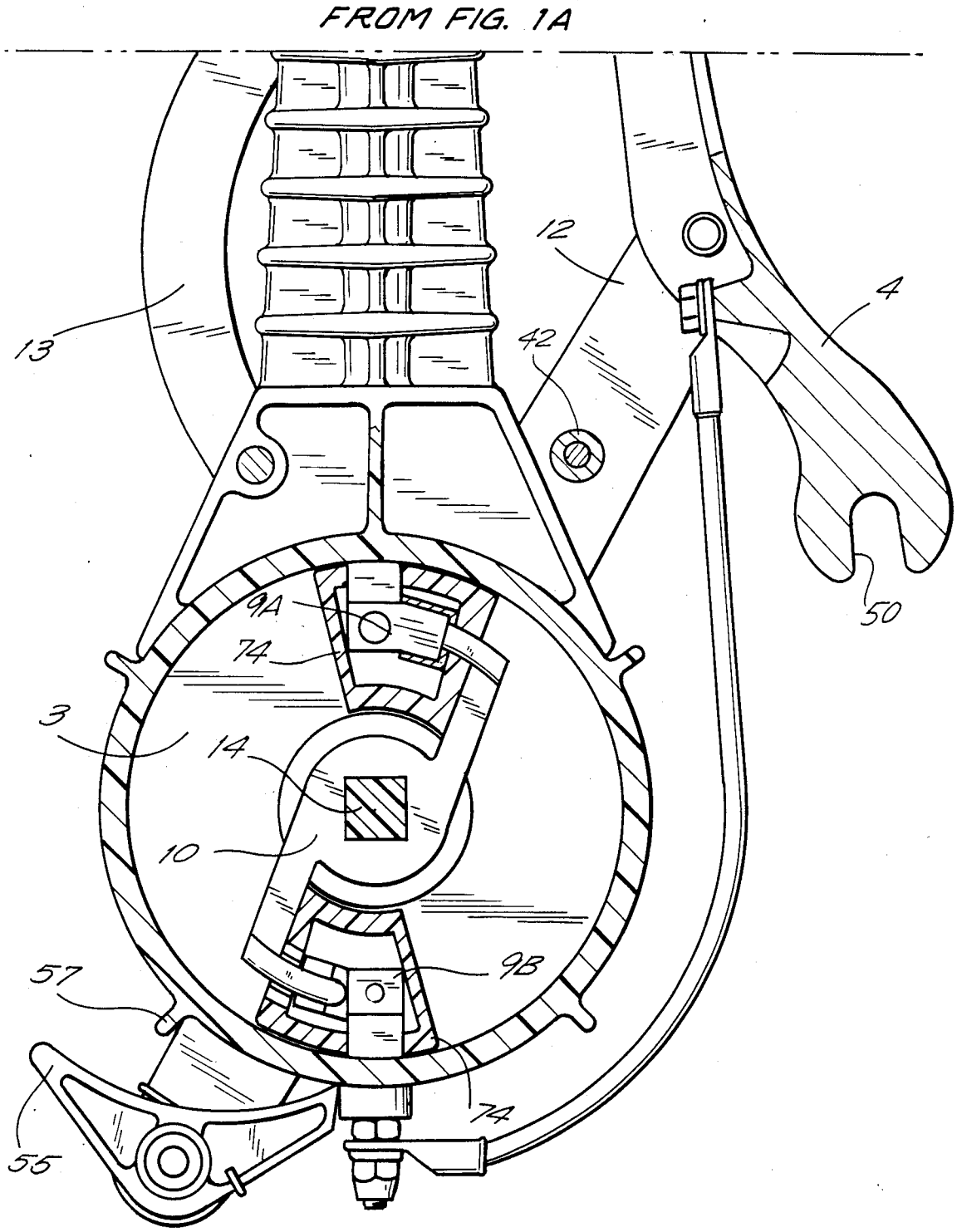
FIG. 5 is a view similar to that of the FIG. 1B, but of yet another embodiment where the electric arc quenching is done with the help of arc quenching auto-chambers.

Another embodiment of the device is shown in FIG. 5, in which the bellows are eliminated and only two quenching chambers (74) remain.

There are provided two of these chambers and they fully enclose the two fixed contacts (9A) and (9B).

When the electric arc breaks, the contacts and the electric arc itself heat up these chambers, thus causing the expansion of the gas contained in this inside.

The SF6 gas, thus expanded, is forced to escape through the only opening left, that is, through the opening of the moving contact.

The aerodynamic design for the output of these gases brings about a quick quenching of the electric arc.

I claim:

1. A portable breakload tool for use with electric circuit breaker equipment in power-operated systems having a fixed part and a movable part, the tool comprising a tool body (1) defining an arc quenching chamber; at least one fixed contact (9A 9B) positioned in said chamber; a rotary moving contact (10) positioned in said chamber; externally operated driving means (14) for driving said moving contacts so that said moving contact opens to cut a current off while an electric arc remains confined in said chamber between said fixed contact and said moving contact; a coupling arm (4) connected to said tool body by joints, said driving means being operated by said coupling arm; a tool anchor (5) connectable to the fixed part of the current breaker equipment to fix said tool body to said fixed part; a tool hook connectable to the movable part of said equipment for connecting the tool to said movable part; a release spring (19) operatively connected to said driving means; a tripping mechanism (22) having a tripping pin (24); and a driving cam (27) engageable with said tripping pin and operatively connected to said driving means, wherein a relative movement between said fixed part and said movable part loads said spring and at the end of said movement said cam releases said tripping mechanism which will turn said moving contact to interrupt current without forming an arc outside said body.

2. The tool as defined in claim 1, wherein said chamber is filled with sulfur hexafluoride gas for quenching the electric arc.

3. The tool as defined in claim 2, wherein two diametrically opposing fixed contacts are positioned in said chamber, said moving contact being rotatable by said driving means so that a double interruption of the electric current takes place inside said chamber without dependency of a contact opening speed on the speed of operation by an operator.

4. The tool as defined in claim 3, further including a self-blowing system for said gas, said system including bellows (68) and (71) and two blowers, said bellows being operatively connected to said moving contact so that the movement of said moving contact causes a compression of said gas inside said bellows, said gas being carried through said blowers and directed towards the electric arc to quench the same.

5. The tool as defined in claim 3, wherein said moving contact is freely movable inside said gas, each of said fixed contacts being surrounded by an arc quenching chamber whereby a blow of the sulfur hexafluoride gas is caused by temperature increase in said chambers, which causes an increase in pressure inside said chambers.

6. The tool as defined in claim 1, wherein said chamber is filled with insulating oil for quenching the electric arc.

7. The tool as defined in claim 3, further including insulation means including a liquid joint system for insulating the sulfur hexafluoride gas inside said chamber, said liquid joint system including a retainer assembly preventing gas from escaping said chamber, wherein said gas while attempting to escape forcing the oil to press against said retainer assembly.

* * * * *